US006241050B1

(12) United States Patent
Hikita et al.

(10) Patent No.: US 6,241,050 B1
(45) Date of Patent: Jun. 5, 2001

(54) ELEVATOR CONTROL APPARATUS FOR MINIMIZING SERVICE RESPONSE TIMES

(75) Inventors: Shiro Hikita, Tokyo; Masao Yorita, Aichi, both of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/341,268

(22) PCT Filed: Mar. 30, 1998

(86) PCT No.: PCT/JP98/01445

§ 371 Date: Jul. 7, 1999

§ 102(e) Date: Jul. 7, 1999

(87) PCT Pub. No.: WO99/50164

PCT Pub. Date: Oct. 7, 1999

(51) Int. Cl.[7] ..... B66B 1/18
(52) U.S. Cl. ..... 187/386
(58) Field of Search ..... 187/380, 381, 187/382, 385, 386, 387

(56) References Cited

U.S. PATENT DOCUMENTS

| | | | | |
|---|---|---|---|---|
| 4,718,520 | * | 1/1988 | Schroder | 187/127 |
| 5,146,053 | * | 9/1992 | Powell et al. | 187/127 |
| 5,305,198 | * | 4/1994 | Schroder et al. | 187/127 |
| 5,412,163 | * | 5/1995 | Tsuji | 187/382 |
| 5,427,206 | * | 6/1995 | Powell et al. | 187/387 |
| 5,612,519 | * | 3/1997 | Chenais | 187/382 |
| 5,616,896 | * | 4/1997 | Kontturi et al. | 187/384 |
| 5,955,708 | * | 9/1999 | Amano et al. | 187/247 |

FOREIGN PATENT DOCUMENTS

| | | |
|---|---|---|
| 5139635 | 6/1993 | (JP) . |
| 7247066 | 9/1995 | (JP) . |

* cited by examiner

*Primary Examiner*—Jonathan Salata
(74) *Attorney, Agent, or Firm*—Leydig, Voit & Mayer, Ltd.

(57) ABSTRACT

An elevator control manages and controls elevators. The control efficiently minimizes the elevator service time to each floor by minimizing a standard deviation of the expected service time to various floors. The control continually monitors current elevator operation and adjusts the position of unused elevators to maintain quality and efficient elevator service by reducing user wait time.

4 Claims, 17 Drawing Sheets

FIG. 7

| UP | DN |
|---|---|
| — | 0 |
| 2 | 2 |
| 4 | 4 |
| 6 | 6 |
| 8 | 8 |
| 10 | 10 |
| 12 | 12 |
| 14 | 14 |
| 16 | 16 |
| 18 | 18 |
| 20 | 20 |
| 22 | — |

#1

FIG. 8

| UP | DN |
|---|---|
| — | 22 |
| 20 | 20 |
| 18 | 18 |
| 16 | 16 |
| 14 | 14 |
| 12 | 12 |
| 10 | 10 |
| 8 | 8 |
| 6 | 6 |
| 4 | 4 |
| 2 | 2 |
| 0 | — |

#2

FIG. 9

| UP | DN |
|---|---|
| — | 22 |
| 20 | 20 |
| 18 | 18 |
| 16 | 16 |
| 14 | 14 |
| 12 | 12 |
| 10 | 10 |
| 8 | 8 |
| 6 | 6 |
| 4 | 4 |
| 2 | 2 |
| 0 | — |

#3

FIG. 10

| UP | DN |
|---|---|
| — | 0 |
| 2 | 2 |
| 4 | 4 |
| 6 | 6 |
| 8 | 8 |
| 10 | 10 |
| 10 | 10 |
| 8 | 8 |
| 6 | 6 |
| 4 | 4 |
| 2 | 2 |
| 0 | — |

FIG. 15

| UP | DN |
|---|---|
| — | 22 |
| 20 | 20 |
| 18 | 18 |
| 16 | 16 |
| 14 | 14 |
| 12 | 12 |
| 10 | 10 |
| 8 | 8 |
| 6 | 6 |
| 4 | 4 |
| 2 | 2 |
| 0 | — |

#2

FIG. 16

| UP | DN |
|---|---|
| — | 12 |
| 10 | 10 |
| 8 | 8 |
| 6 | 6 |
| 4 | 4 |
| 2 | 2 |
| 0 | 0 |
| 2 | 2 |
| 4 | 4 |
| 6 | 6 |
| 8 | 8 |
| 10 | — |

#3

FIG. 17

| UP | DN |
|---|---|
| — | 0 |
| 2 | 2 |
| 4 | 4 |
| 6 | 6 |
| 4 | 4 |
| 2 | 2 |
| 0 | 0 |
| 2 | 2 |
| 4 | 4 |
| 4 | 4 |
| 2 | 2 |
| 0 | — |

FIG. 24

| UP | DN |
|---|---|
| — | 10 |
| 8 | 8 |
| 6 | 6 |
| 4 | 4 |
| 2 | 2 |
| 0 | 0 |
| 2 | 2 |
| 4 | 4 |
| 6 | 6 |
| 8 | 8 |
| 10 | 10 |
| 12 | — |

#2

FIG. 25

| UP | DN |
|---|---|
| — | 22 |
| 20 | 20 |
| 18 | 18 |
| 16 | 16 |
| 14 | 14 |
| 12 | 12 |
| 10 | 10 |
| 8 | 8 |
| 6 | 6 |
| 4 | 4 |
| 2 | 2 |
| 0 | — |

#3

FIG. 26

| UP | DN |
|---|---|
| — | 0 |
| 2 | 2 |
| 4 | 4 |
| 4 | 4 |
| 2 | 2 |
| 0 | 0 |
| 2 | 2 |
| 4 | 4 |
| 6 | 6 |
| 4 | 4 |
| 2 | 2 |
| 0 | — |

FIG. 31

| | | | | | | | | | | | | |
|---|---|---|---|---|---|---|---|---|---|---|---|---|
| — | 8 | 6 | 4 | 2 | 0 | 2 | 4 | 6 | 8 | 10 | 12 | UP |
| 10 | 8 | 6 | 4 | 2 | 0 | 2 | 4 | 6 | 8 | 10 | — | DN |

#2

FIG. 32

| | | | | | | | | | | | | |
|---|---|---|---|---|---|---|---|---|---|---|---|---|
| — | 18 | 16 | 14 | 12 | 10 | 8 | 6 | 4 | 2 | 0 | 2 | UP |
| 20 | 18 | 16 | 14 | 12 | 10 | 8 | 6 | 4 | 2 | 0 | — | DN |

#3

FIG. 33

| | | | | | | | | | | | | |
|---|---|---|---|---|---|---|---|---|---|---|---|---|
| — | 2 | 4 | 4 | 2 | 0 | 2 | 4 | 4 | 2 | 0 | 2 | UP |
| 0 | 2 | 4 | 4 | 2 | 0 | 2 | 4 | 4 | 2 | 0 | — | DN |

ELEVATOR CONTROL APPARATUS FOR MINIMIZING SERVICE RESPONSE TIMES

TECHNICAL FIELD

The present invention relates to an elevator control apparatus that controllably manages a plurality of elevators which are operating.

BACKGROUND ART

Up to now, in the case where a plurality of elevators are provided together, those elevators are operated under group control. An assigning system is applied as one of group-managed operation, in which an assignment evaluation value is arithmetically operated for each elevator cage immediately after an elevator hall call is registered, and the evaluation value is assigned to the best elevator cage as a cage to be served so that only the cage to be assigned is responsive to the elevator hall call.

Furthermore, there are the following group managing systems that are made to improve the running efficiency and to reduce a waiting period on the elevator hall.

(a) As disclosed in Japanese Patent Unexamined Publication No. Hei 7-247066, in order to reduce the number of states where the elevator is not waiting on a reference floor, a departure time interval at which the elevator departs from the reference floor is controlled.

(b) As disclosed in Japanese Patent Unexamined Publication No. Hei 5-139635, the return of the elevator to the reference floor and dispersive waiting are employed together to control the elevator such that the services of the transportation from the reference floor and the transportation between the floors are improved.

However, the above-described prior art suffers from the following problems.

First, the prior art disclosed in Japanese Patent Unexamined Publication No. Hei 7-247066 is effective in the case where floors high in frequency of use at the time of attending and leaving office, etc., can be specified. However, since only the known specified floors are not always confused, it is not effective in other cases.

Second, the prior art disclosed in Japanese Patent Unexamined Publication No. Hei 5-139635 conducts only the waiting operation on the reference floor (specified floor) and the specified floor other than the reference floor regardless of the frequency of use on each floor. Thus, because the service other than the specified floors is not considered, if a waiting mode on the specified floors is entered, the service on the floors other than the specified floors is further degraded.

Therefore, the present invention has been made to solve the above-described problems, and an object of the present invention is to provide an elevator control apparatus which is capable of improving the services of the entire elevator system by unifying the service on each floor and performing group management control with more efficiency.

DISCLOSURE OF THE INVENTION

An elevator control apparatus according to the present invention comprises: cage assignment means for assigning an elevator to be responsive to an elevator hall call through an elevator floor button from a plurality of elevators; service enable time calculating means for calculating a service enable time which is a predicted arrival time of a cage which can respond to an elevator hall call on each floor fastest; deviation calculating means for calculating a deviation index from a distribution of the service enable time which is calculated by the above-described service enable time calculating means; transportation judging means for judging whether transportation is necessary on the basis of whether the deviation index which is calculated by the above-described deviation calculating means exceeds a given value; transportation specifying means for specifying a cage and a transportation floor by which the deviation index is most improved through the transportation when the above-described transportation judging means judges that the transportation is necessary; and transportation means for sending a transportation instruction to the cage specified by the above-described transportation specifying means so as to transport the cage to the specified floor.

Also, the above-described service enable time calculating means is characterized by calculating the service enable time on each floor after a mean interval of generation of elevator hall calls.

Also, the above-described deviation calculating means is characterized by calculating at least one of a mean value, a standard deviation and a maximum value of the service enable time as the deviation index.

Also, the elevator control apparatus further comprises deviation correction judging means for judging whether the transportation should be made on the basis of judgement of whether a deviation correction level satisfies a predetermined condition by the transportation of the cage specified by the above-described transportation specifying means to a specified floor characterized in that the above-described transportation means sends the transportation instruction to the cage specified by the above-described transportation specifying means so as to transport the cage to the specified floor when the above-described deviation correction judging means judges that the transportation should be made.

Further, the above-described deviation correction judging means is characterized by judging whether the deviation correction level satisfies the predetermined condition by judging whether the deviation is corrected by not less than a given value on the basis of comparison of the deviation index calculated by the above-described deviation calculating means with the deviation index when the transportation specified by the above-described transportation specifying means is made.

BRIEF DESCRIPTION OF THE DRAWINGS

In the accompanying drawings:

FIG. 7 is an explanatory diagram of the service enable time in the embodiment mode 1 of the present invention;

FIG. 8 is an explanatory diagram of the service enable time in the embodiment mode 1 of the present invention;

FIG. 9 is an explanatory diagram of the service enable time in the embodiment mode 1 of the present invention;

FIG. 10 is an explanatory diagram of the service enable time in the embodiment mode 1 of the present invention;

FIG. 15 is an explanatory diagram of the service enable time in the embodiment mode 1 of the present invention;

FIG. 16 is an explanatory diagram of the service enable time in the embodiment mode 1 of the present invention;

FIG. 17 is an explanatory diagram of the service enable time in the embodiment mode 1 of the present invention;

FIG. 24 is an explanatory diagram of the service enable time in the embodiment mode 2 of the present invention;

FIG. 25 is an explanatory diagram of the service enable time in the embodiment mode 2 of the present invention;

FIG. 26 is an explanatory diagram of the service enable time in the embodiment mode 2 of the present invention;

FIG. 31 is an explanatory diagram of the service enable time in the embodiment mode 2 of the present invention;

FIG. 32 is an explanatory diagram of the service enable time in the embodiment mode 2 of the present invention;

FIG. 33 is an explanatory diagram of the service enable time in the embodiment mode 2 of the present invention.

BEST MODES FOR CARRYING OUT THE INVENTION

Hereinafter, the present invention will be described with reference to the drawings.

Figure 1:
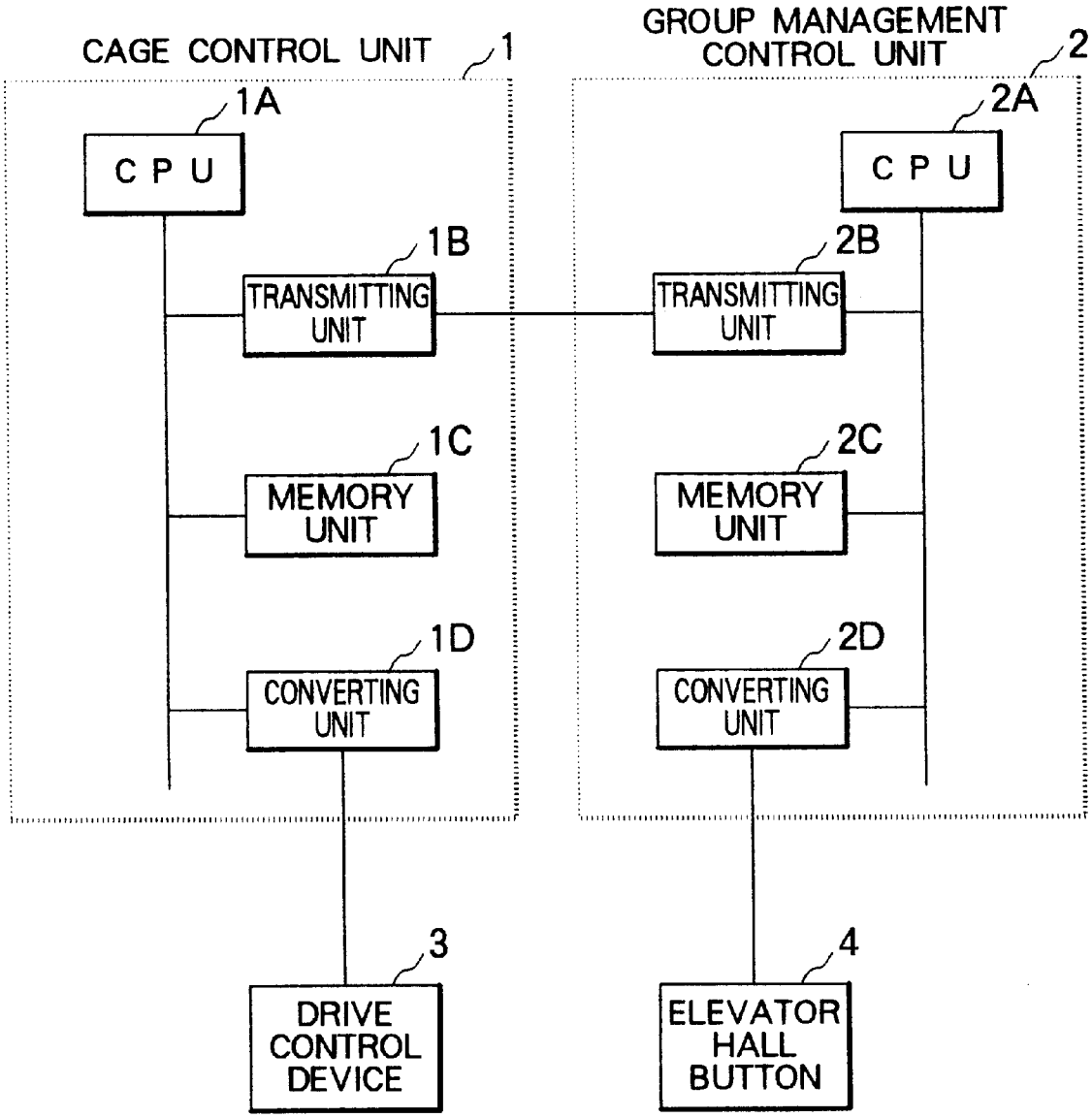
FIG. 1 is an entire structural diagram showing an elevator control apparatus according to the present invention.

FIG. 1 is an entire structural diagram showing an elevator control apparatus according to the present invention.

In FIG. 1, reference numeral 1 denotes a cage control unit made up of a microcomputer (hereinafter referred to as "micon"), including a central processing unit (hereinafter referred to as "CPU") 1A, a transmitting unit 1B which transmits and receives data with respect to a group management control unit, a memory unit 1C which stores program and data therein, and a converting unit 1D which converts an input/output signal level, and the converting unit 1D is connected with a drive control device 3 that controls the drive of the cages.

Also, reference numeral 2 denotes a group management control unit made up of a microcomputer as in the cage control unit 1, and includes a CPU 2A, a transmitting unit 2B, a memory unit 2C, and a converting unit 2D, likewise, and the converting unit 2D is connected with an elevator hall button 4 provided on an elevator hall on each floor for registering an elevator hall call. The cage control unit 1 and the group management control unit 2 are connected to each other through the transmitting units 1B and 2B.

Although FIG. 1 shows the structure of the cage control unit 1 corresponding to one cage, the cage control units 1 are in fact provided in correspondence with the cages of the respective elevators to be managed in group, and those cage control units 1 are connected to the group management control unit 2 through the transmitting units as shown.

Embodiment Mode 1

Figure 2:
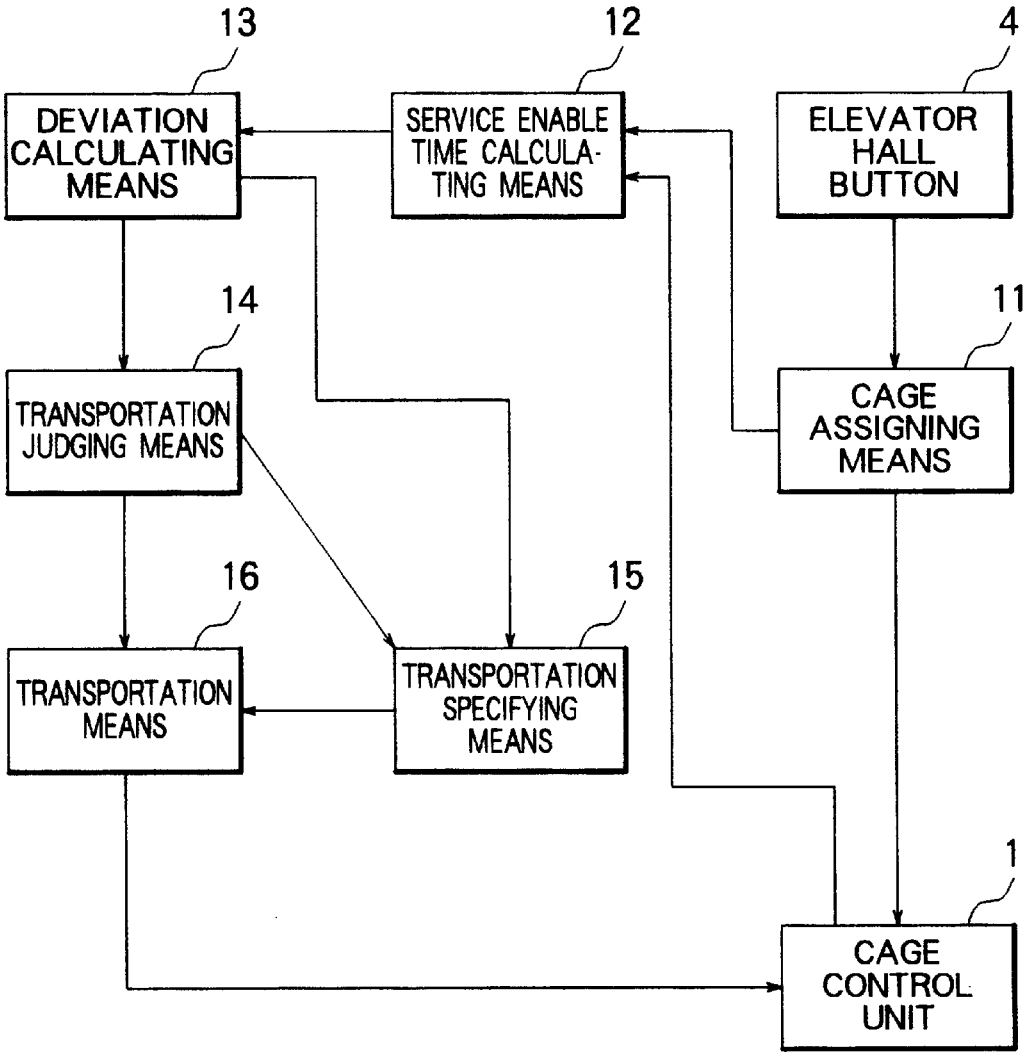
FIG. 2 is a structural block diagram showing the function of an elevator control apparatus according to an embodiment mode 1 of the present invention.

FIG. 2 is a block structural diagram for explaining the function of the CPU 2A according to the program stored in the memory unit 2C of the group management control unit 2 shown in FIG. 1, in order to explain the function of an elevator control unit according to an embodiment mode 1 of the present invention.

In FIG. 2, reference numeral 11 denotes: cage assignment means for assigning an elevator to be responsive to an elevator hall call from an elevator hall button 4, out of a plurality of elevators, to send an assignment signal to a corresponding the cage control unit 1; 12, service enable time calculating means for calculating a service enable time which is a predicted arrival time of a cage which can respond to an elevator hall call on each floor fastest; 13, deviation calculating means for calculating a deviation index from a distribution of the service enable tines which are calculated by the above-described service enable time calculating means 12; 14, transportation judging means for judging whether transportation is necessary on the basis of judgement of whether the deviation index which is calculated by the above-described deviation calculating means 13 exceeds a given value 15, transportation specifying means for specifying a cage and a transportation floor by which the deviation index is most improved through the transportation when the above-described transportation judging means 14 judges that the transportation is necessary; and 16, transportation means for sending a transportation instruction to the cage control unit 1 of the cage specified by the above-described transportation specifying means 15 so as to transport the cage to the specified floor.

The operation of this embodiment mode 1 will now be described with reference to a flowchart shown in FIG. 3.

In this example, since a technique in which the elevator to respond to the elevator hall call from the elevator hall button 4 is assigned, from a plurality of elevators by sending the assignment signal to the corresponding cage control unit 3 is known, its description will be omitted, and the subsequent operation will be described.

First, in step S31, after a given period of time, the service enable time after the mean interval of generation of the elevator hall calls on each floor is calculated by the service enable time calculating means 12. This procedure will be described in more detail with reference to FIGS. 4 to 10.

Figure 4:
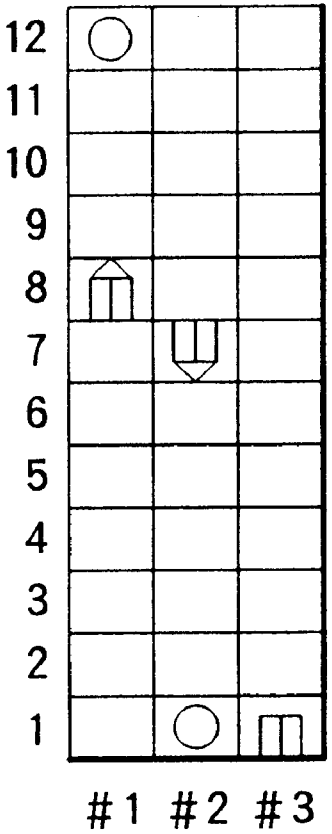
FIG. 4 is an explanatory diagram of a service enable time in the embodiment mode 1 of the present invention.

Now, a state shown in FIG. 4 will be described as an example. In FIG. 4, #1 and #2 show states in which the cage is traveling in the UP (up) and DN (down) directions, respectively, and cage waiting is indicated by circles on a twelfth floor and a first floor respectively. Travel occurs by depressing one of destination buttons of a cage operating board within a cage (not shown). Also, a cage #3 is waiting for a door to close on the first floor.

The positions and states of the respective cages at a given time (L seconds) after that state are predicted. The given time L seconds may be obtained by the mean interval of generation of the elevator hall calls during a time band, etc. Also, the positions and states of the respective cages after L seconds can be obtained from the results of calculation of the predicted arrival time.

The predicted arrival time is a calculated time necessary for a certain cage to arrive at a specified floor and can be calculated from travel time and stop time. The travel time can be calculated from the velocity, acceleration, jerk (rate of change of acceleration) and an inter-floor distance for a cage. Also, the stop time can be calculated from a door open/close time and getting on/off time of a passenger. A method of calculating the predicted arrival time is known, and therefore its details will be omitted. In the actual group management control, fine calculation is made using the above data, but in the present specification, for simplification of explanation, the following description is given, assuming that the travel time is 2 sec/floor, and the stop time is 10 sec/stop uniformly.

Figure 6:
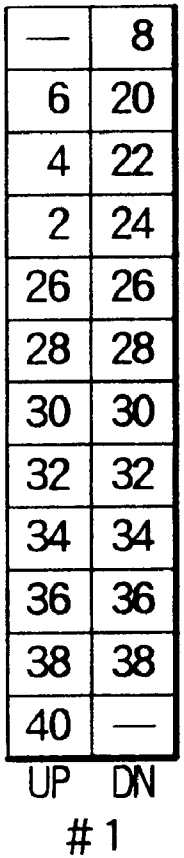
FIG. 6 is an explanatory diagram of the service enable time in the embodiment mode 1 of the present invention.

FIG. 6 shows a predicted arrival time of the cage #1 shown in FIG. 4 in correspondence with the UP and DOWN directions on each floor at this time.

In FIG. 6, the left side is a predicted arrival time in the UP direction on each floor, and its right side is the arrival time in the DN direction. The cage #1 travels in the UP direction up to the 12-th floor, and after being reversed once, travels in the DN direction. Accordingly, for example, in order to arrive in the DN direction at the 10-th floor, the cage goes through the 12-th floor from the present position and then arrives at the 10-th floor. Also, since the cage has no call after the cage is reversed on the 12-th floor, the predicted arrival time takes the same value in both of the UP and DN directions on the floors lower than the 8-th floor.

Figure 5:
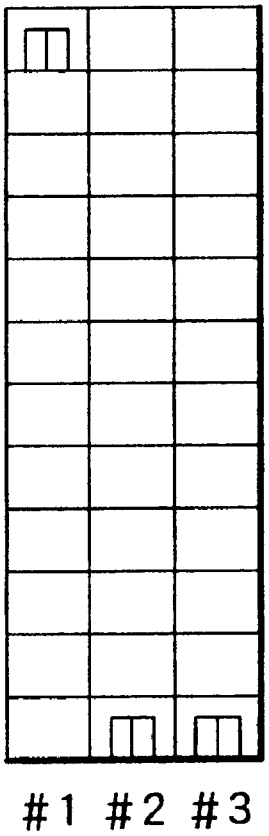
FIG. 5 is an explanatory diagram of the service enable time in the embodiment mode 1 of the present invention.

FIG. 5 shows the positions and states of the respective cages 10 seconds (L=10) after the state of FIG. 4.

Also, the predicted arrival times of the respective cages at this time are shown in FIGS. 7 to 9, respectively. The service enable time after 10 seconds (L=10) is obtained from those values.

The service enable time calculations can be made by taking the minimum values N of FIGS. 7 to 9.

The service enable time means the predicted arrival time of a cage which can respond to the elevator hall call fastest in the case where the elevator hall call is generated on a certain floor after 10 seconds (L=10). The calculated results are shown in FIG. 10.

Figure 3:
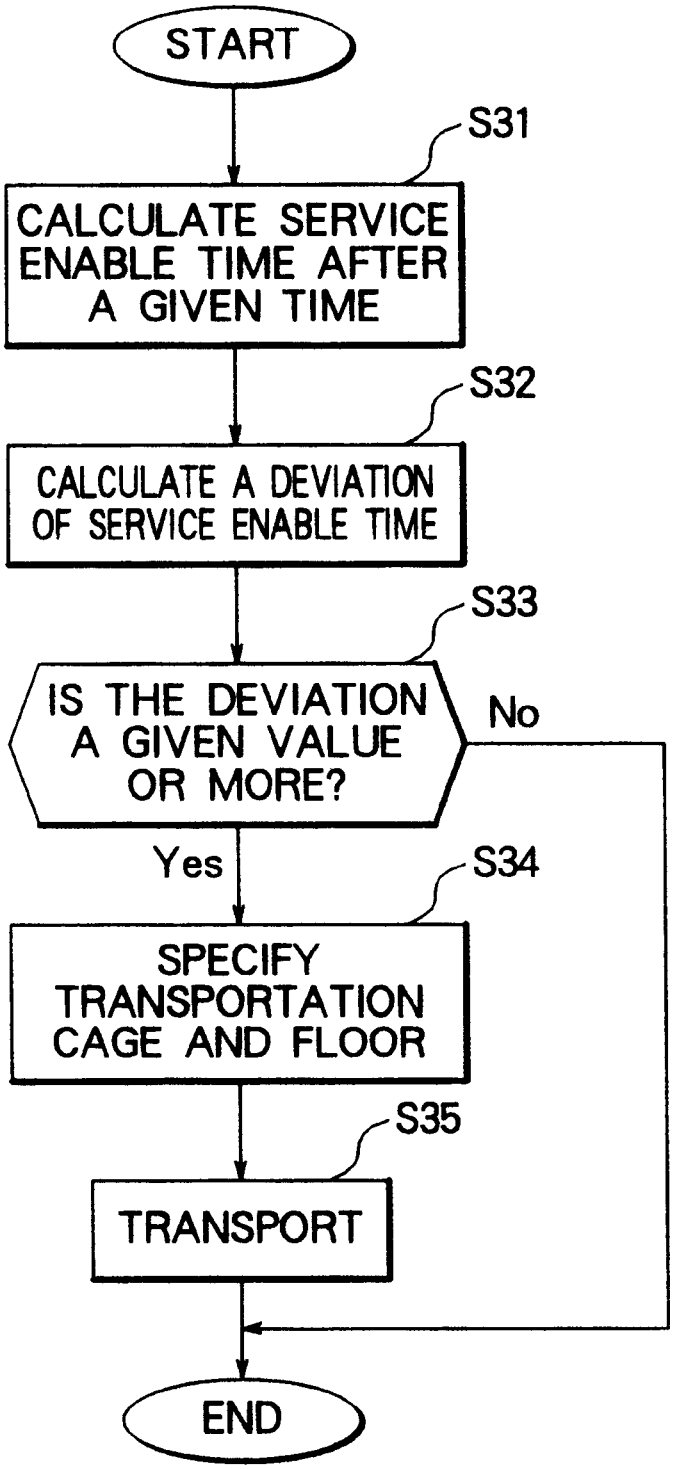
FIG. 3 is a flowchart for explaining the operation of the embodiment mode 1 shown in FIG. 2.

The above description is the procedure of step S31 shown in FIG. 3.

Then, returning to the flowchart shown in FIG. 3, after the service enable time is calculated in step S31, control proceeds to step S32 where a deviation index is calculated from the distribution of the service enable times by the deviation calculating means 13.

The deviation index may be at least one of the mean value, the standard deviation and the maximum value of the service enable time. The deviation index calculated from the service enable time shown in FIG. 10 is shown in FIG. 11.

Figure 11:
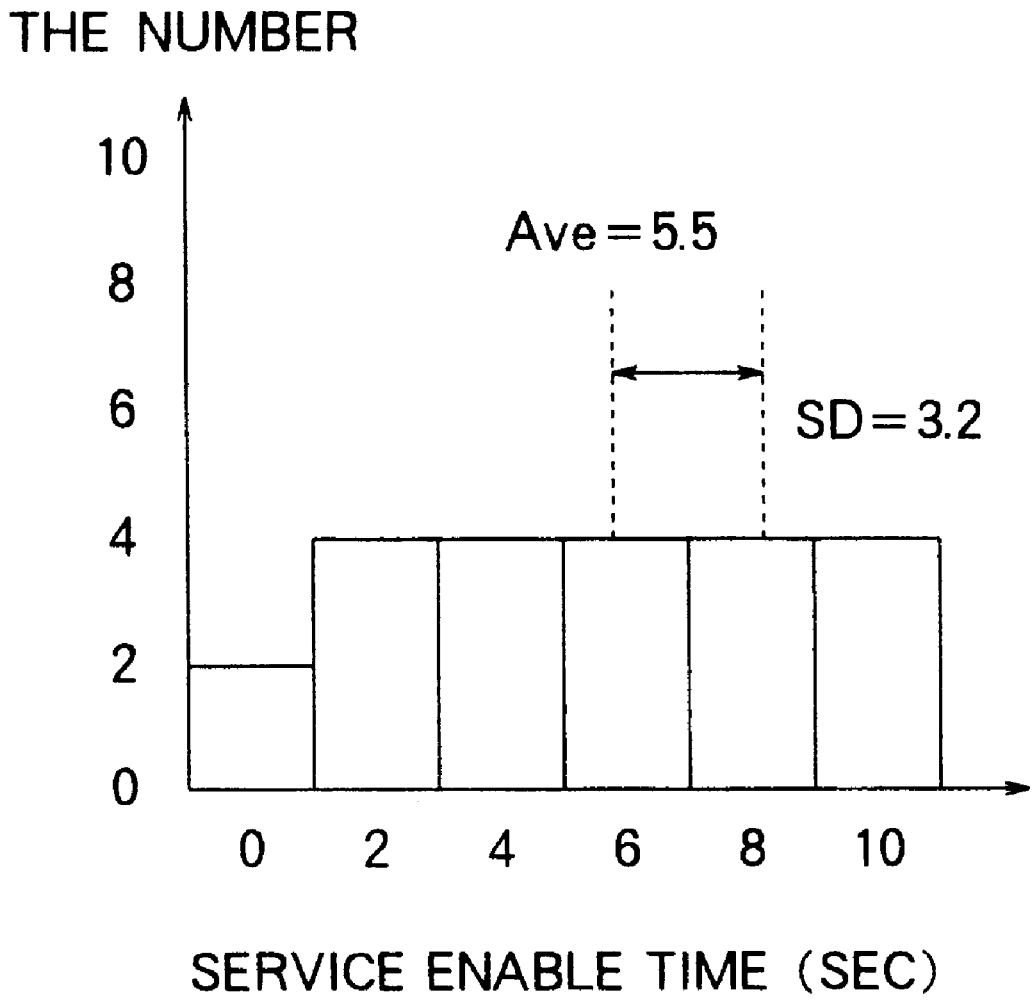
FIG. 11 is an explanatory diagram of a deviation index of the service enable time in the embodiment mode 1 of the present invention.

In FIG. 11, symbol Ave designates the mean value, and SD is the standard deviation. In the case where those values are large, it is predicted that the service is degraded when a call is generated at the specified floor in the near future (after L seconds). Conversely, in the case where those values are small, it means the state in which any cage can respond to the call quickly even if a call is generated on any floor.

Then, returning to the flowchart shown in FIG. 3, control proceeds to step S33, where it is judged by the transportation judging means 14 whether transportation is required on the basis of weather the calculated deviation index is a constant value. In other words, in the case where the deviation is large and no transportation is made, it is judged whether the prospective service degradation is predicted. In this judgement, for example, it is judged whether the mean value of the service enable time is larger than the mean waiting time in that time band, or whether the standard deviation is within a times of the means waiting time, after a certain threshold value a is set, etc.

In the above step S33, in the case where it is judged that the deviation is small so that the transportation is unnecessary ("No" in step S33) , control proceeds to step S36, and control is completed without carrying out further procedure. Conversely, in the case where it is judged that the deviation is large so that the transportation is necessary ("Yes" in step S33), control proceeds to step S34 where the cage and the floor are specified by the transportation specifying means 15. The procedure will be described in more detail with reference through FIGS. 12 to 18.

Figure 12:
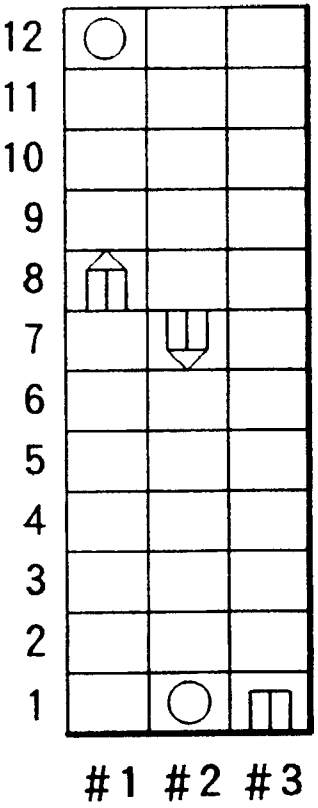
FIG. 12 is an explanatory diagram of the service enable time in the embodiment mode 1 of the present invention.

FIG. 12 shows the same state as that of FIG. 4. At this time, since the cage that is waiting for the door to close is only the cage #3, the cage #3 becomes an object to be transportation-instructed. In the case where the cage #3 is transported from the state shown in FIG. 12 to the 6-th floor, it is predicted that a state after 10 seconds (L=10) becomes a state shown in FIG. 13.

Figure 13:
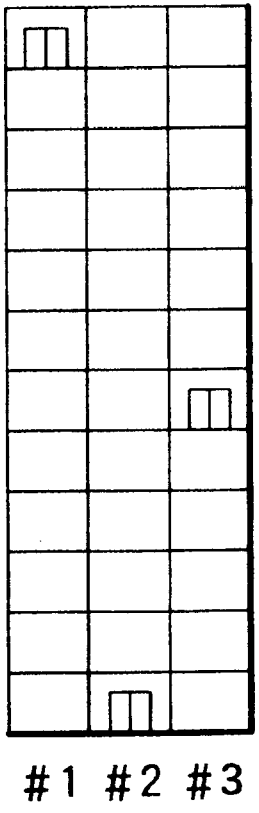
FIG. 13 is an explanatory diagram of the service enable time in the embodiment mode 1 of the present invention.
Figure 14:
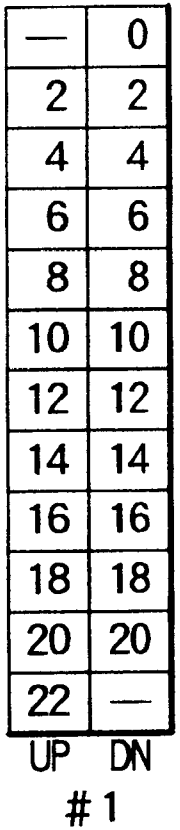
FIG. 14 is an explanatory diagram of the service enable time in the embodiment mode 1 of the present invention.
Figure 18:
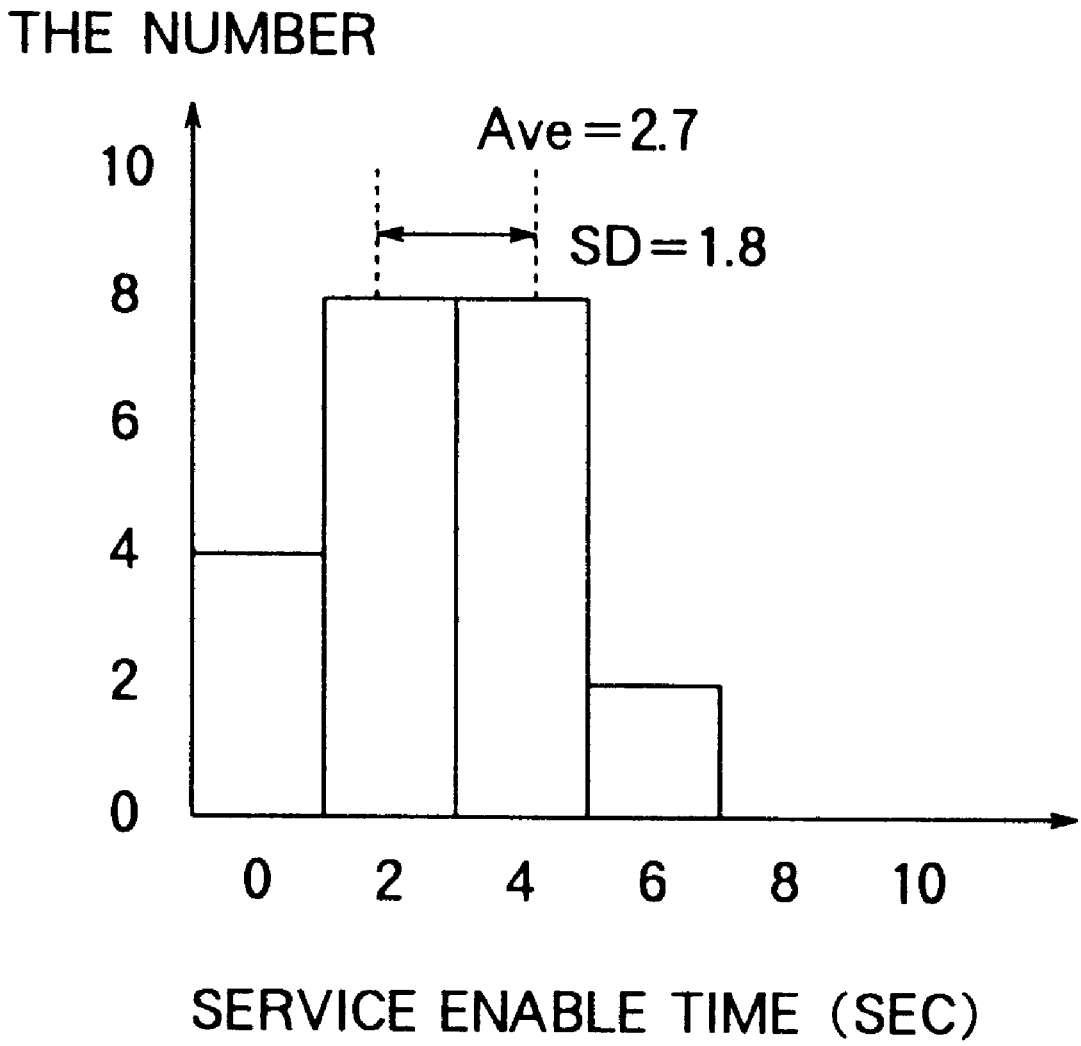
FIG. 18 is an explanatory diagram of the deviation index of the service enable time in the embodiment mode 1 of the present invention.

FIGS. 14 to 16 show the predicted arrival times of each cage at the time of FIG. 13, and FIG. 17 shows a service enable time calculated from FIGS. 14 to 16. The deviation index calculated from this is shown in FIG. 18.

The procedure of calculating them is identical with that of steps S31 and S32. In this way, the deviation index when the cage #3 is transported to the 6-th floor can be calculated. In the same manner, the deviation index when the cage #3 is transported to the respective floors can be calculated. In this example, only the cage #3 is an object to be transportation-instructed, but the same calculation can be made even in the case where another cage exists. From FIGS. 11 to 18, the mean value is improved from 5.5 seconds to 2.7 seconds, the maximum value is improved from 10 seconds to 8 seconds, and the standard deviation is improved from 3.2 seconds to 1.8 seconds.

In the above way, the deviation index in each case is calculated, and the most improved cage and transportation floor are selected. The above is the description of step S34.

Then, returning to the flowchart shown in FIG. 3, when the cage and floor are specified in the above manner, a transportation instruction is given to the cage control unit 1 of the specified cage by the transportation means 16 in step S35 so that the cage control unit 1 that receives the instruction transports the cage to the specified floor.

With the application of the above mode, a difference in service enable time to the respective floors (a difference between the predicted maximum arrival time and the predicted minimum arrival time) is reduced, and even if a call is generated on any floor in the near future (after L seconds) , a state where any cage can respond to the call quickly can be kept, to thereby improve the service of the elevator.

Embodiment Mode 2

Figure 19:
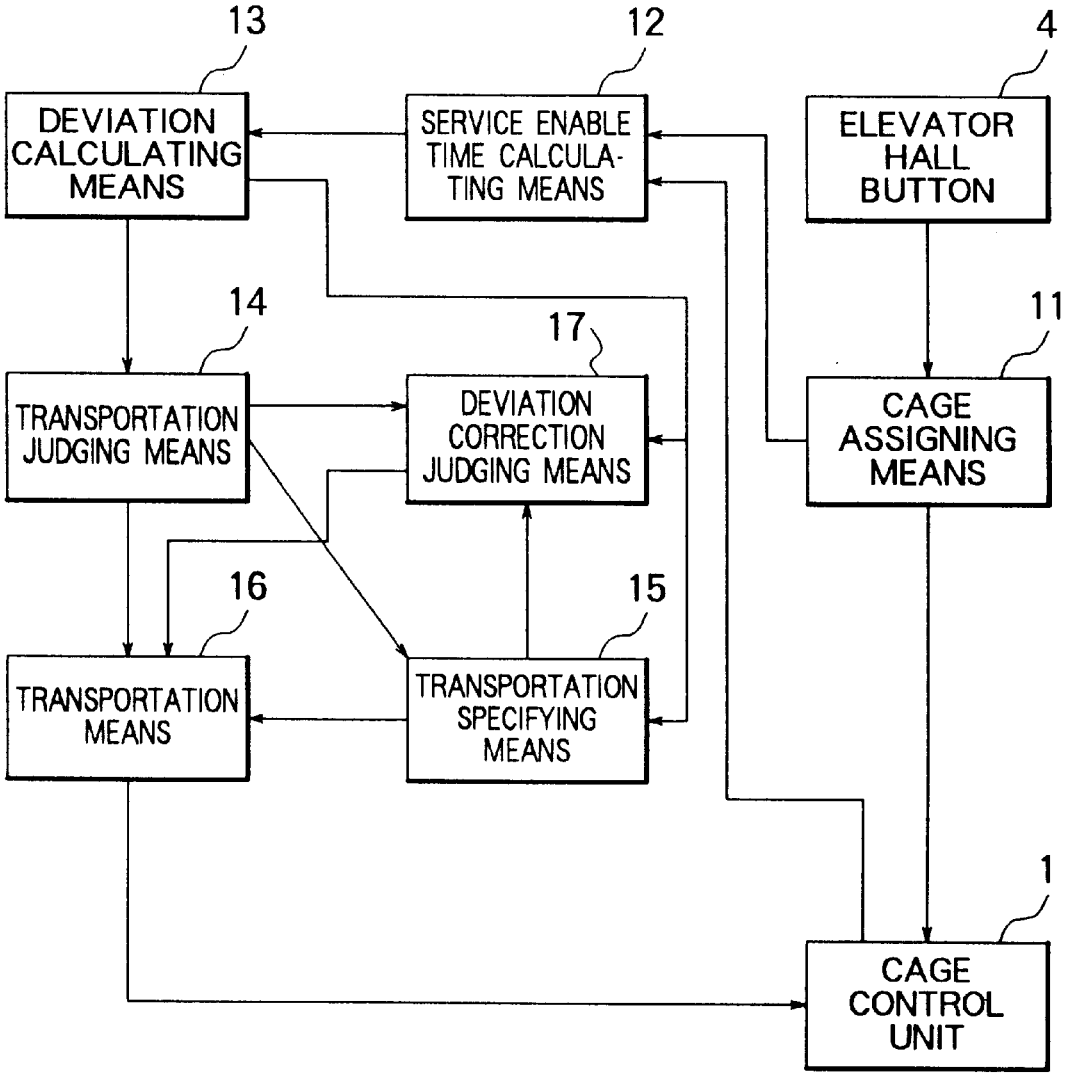
FIG. 19 is a structural block diagram showing the function of an elevator control apparatus according to an embodiment mode 2 of the present invention.

FIG. 19 is a block structural diagram for explaining the function of the CPU 2A according to the program stored in the memory unit 2C of the group management control unit 2 shown in FIG. 1, in order to explain the function of an elevator control unit according to an embodiment mode 2 of the present invention.

In FIG. 19, the same parts as those in the embodiment mode 1 shown in FIG. 2 are designated by identical symbols, and their description will be omitted. As a new reference numeral, reference numeral 17 denotes deviation correction judging means for judging whether the transportation should be made based on the of judgement of whether a deviation correction level satisfies a predetermined condition by the transportation of the cage specified by the transportation specifying means 15 to a specified floor, and the transportation means 16 is designed to send the transportation instruction to the cage specified by the transportation specifying means 15 so as to transport the cage to the specified floor when the deviation correction judging means 17 judges that the transportation should be made.

Then, the operation of the embodiment mode 2 will be described with reference to a flowchart shown in FIG. 20.

Like the embodiment mode 1, first in step S81, the service enable time after a given time, that is, after the mean interval of generation of the elevator hall calls on each floor is calculated by the service enable time calculating means 12, and in step S82, the deviation index is calculated using the calculated result in step S81 by the deviation calculating means 13.

Then, in step S83, it is judged by the transportation judging means 14 whether the deviation index is not less than a constant value, or not. In case of "No" in step S83, processing is completed as it is, but in case of "Yes", the cage and floor to be transported are specified in step S84.

The procedure of steps S81 to S84 are the same as steps S31 to S34 in FIG. 3, described above.

Then, in step S85, the deviation correction judging mean 17 compares the deviation index calculated in steps S81 and S82, that is, the deviation index after a given time (L seconds) when the transportation is not conducted with the deviation index when the transportation specified in step S84 is conducted. Then, in the case where the deviation is corrected by a given amount or more ("Yes" in step S84) , a transportation instruction is sent by the transportation means 16 in step S86.

The procedure of the step S86 is identical with step S36 in FIG. 3. Conversely, in the case where the deviation is not corrected by the given amount or more ("No" in step S84) the processing is completed as it is without transportation.

The above procedure will be described in more detail with reference to FIGS. 21 to 34.

Figure 21:
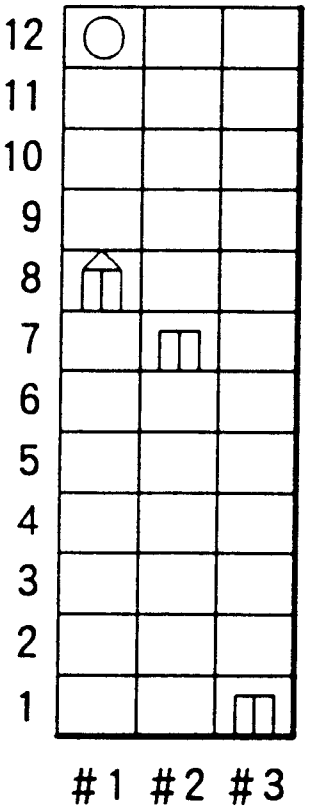
FIG. 21 is an explanatory diagram of a service enable time in the embodiment mode 2 of the present invention.

A state shown in FIG. 21 will be described as an example. In FIG. 21, the cage #1 shows states in which the cage is travelling in the UP (up) direction. Cage waiting indicated by a circle on the twelfth floor is made by depressing one of destination buttons of a cage operating board within a cage (not shown). Also, the cages #2 and #3 are waiting for a door to close on the 7-th and 1-st floors, respectively.

Figure 22:
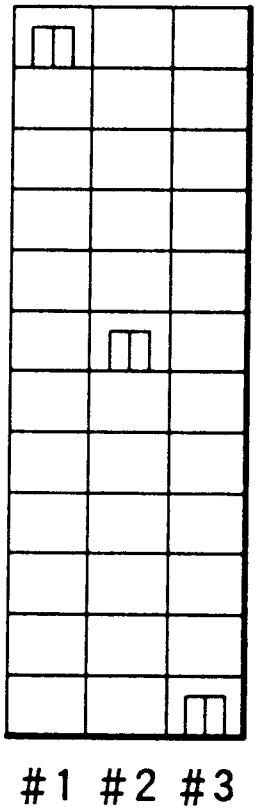
FIG. 22 is an explanatory diagram of the service enable time in the embodiment mode 2 of the present invention.
Figure 23:
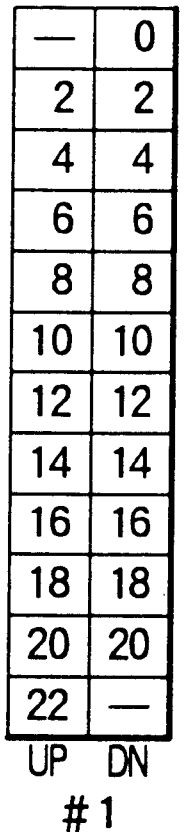
FIG. 23 is an explanatory diagram of the service * enable time in the embodiment mode 2 of the present invention.
Figure 27:
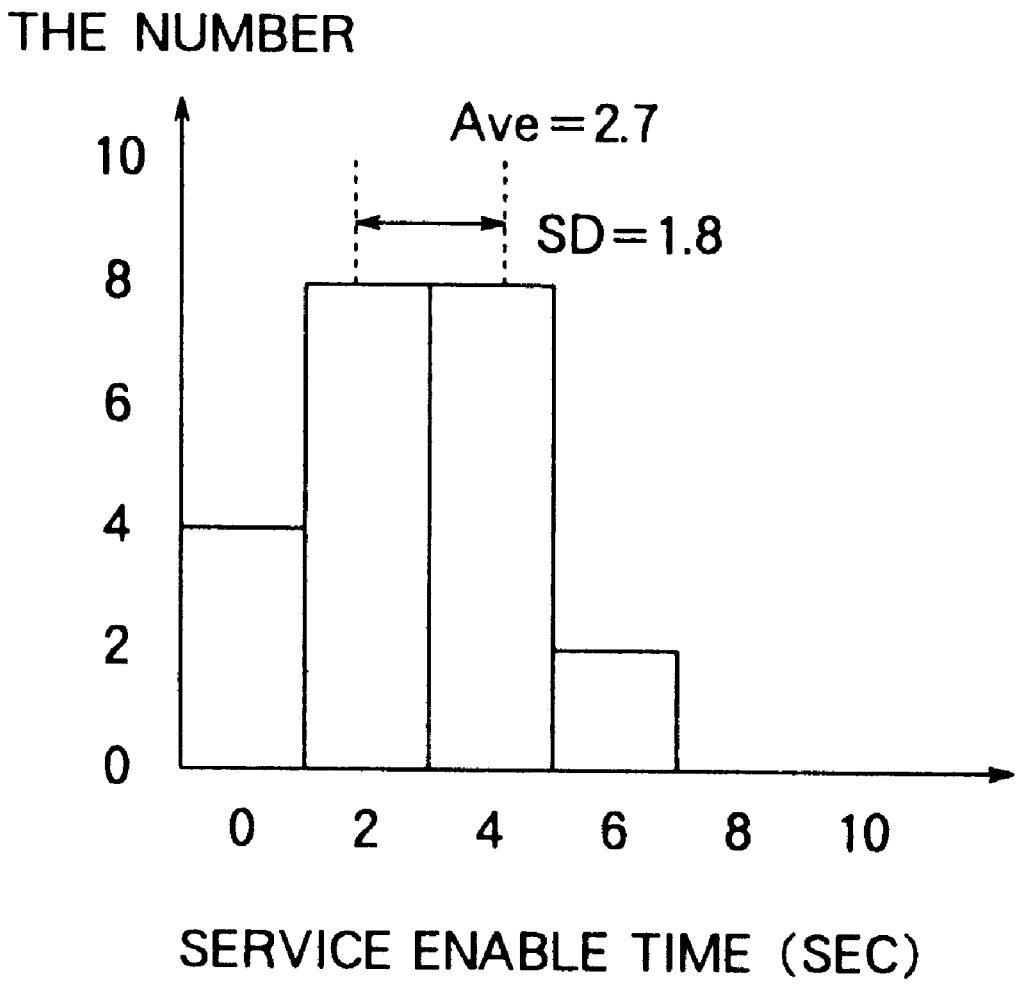
FIG. 27 is an explanatory diagram of a deviation index of the service enable time in the embodiment mode 2 of the present invention.

Unless the transportation is performed in this state, it is predicted that it comes to a state shown in FIG. 22 after 10 seconds (L=10). The predicted arrival times of the respective cages in the state of FIG. 22 are shown in FIGS. 23 to 25, and the service enable time calculated from them is shown in FIG. 26. Further, the deviation index is shown in FIG. 27.

Also, a case where the deviation index is most improved is when the cage #3 is transported to the 2-nd floor at the time of FIG. 21.

Figure 28:
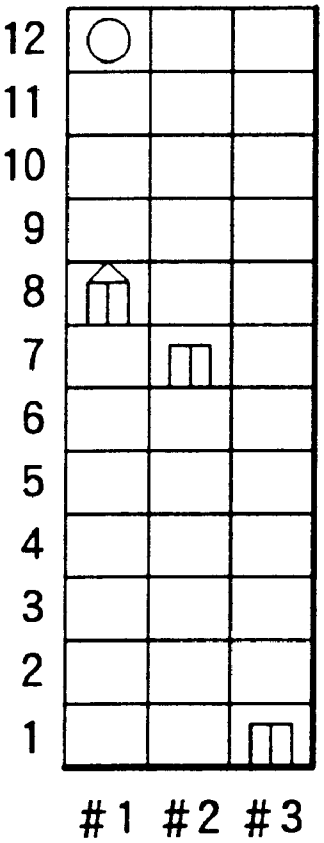
FIG. 28 is an explanatory diagram of the service enable time in the embodiment mode 2 of the present invention.
Figure 29:
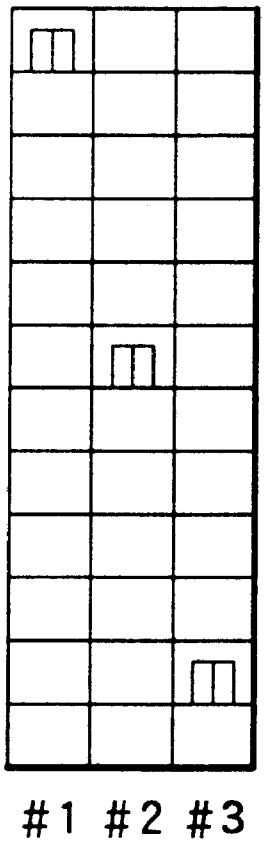
FIG. 29 is an explanatory diagram of the service enable time in the embodiment mode 2 of the present invention.

This is specified in step S84 (the same as step S34) In the case where the cage #3 is transported to the 2-nd floor, it is predicted that the state becomes a state of FIG. 29 after 10 seconds (L=10), that is, that the cages #1 to #3 are waiting for the door to be closed on the 12-th floor, the 7-th floor and the 1-st floor, respectively. FIG. 28 shows the same state as that of FIG. 21.

Figure 30:
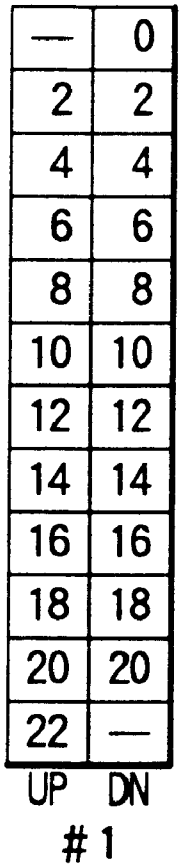
FIG. 30 is an explanatory diagram of the service enable time in the embodiment mode 2 of the present invention.
Figure 34:
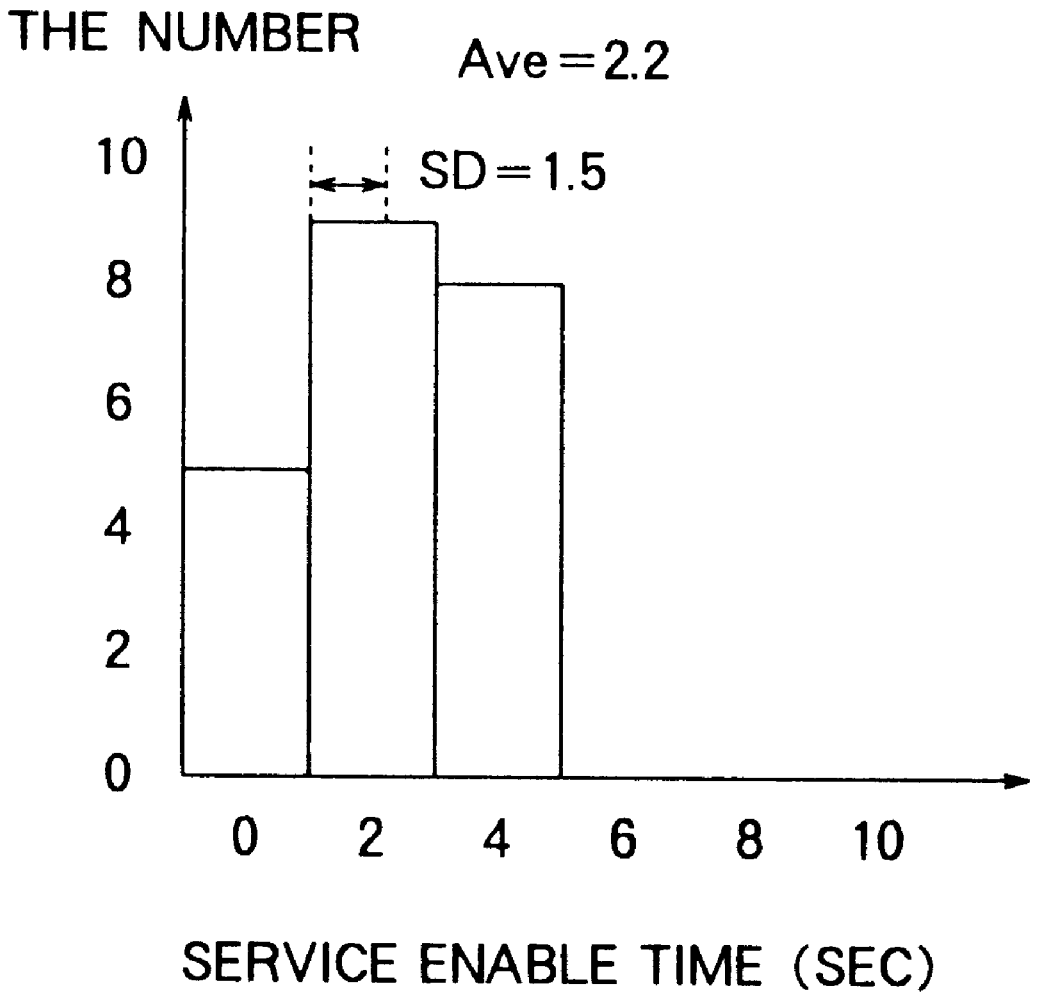
FIG. 34 is an explanatory diagram of the deviation index of the service enable time in the embodiment mode 2 of the present invention.

The predicted arrival time when the cage #3 is transported to the 2-nd floor, that is, the service enable time is shown in FIGS. 30 to 32, and the deviation index is shown in FIG. 34.

Comparing FIG. 27 with FIG. 34, the mean value is improved from 2.7 to 2.2 seconds, the standard deviation is improved from 1.8 to 1.5 seconds, and the maximum value is improved from 6 to 4 seconds.

In this example, the following reference is proposed as a reference of judging the degree of improvement.

In other words, all of the improvements of the respective indexes (mean, standard deviation, maximum) are X% or more, or the respective values are Y seconds or more. The values of X and Y may be set according to the frequency of traffic, but their general values are X: 20% and Y: 3.0 seconds. Applying the above conditions, it is judged that in case of FIG. 11 to FIG. 18, the improvement due to the transportation is large, and in case of FIG. 27 to FIG. 34, it is not large.

With the application of the above mode, since the transportation is conducted only when the improvement of the deviation index is large, useless transportation is omitted so that the transportation is always conducted only in a proper case, to thereby improve the service of the elevator.

Figure 20:
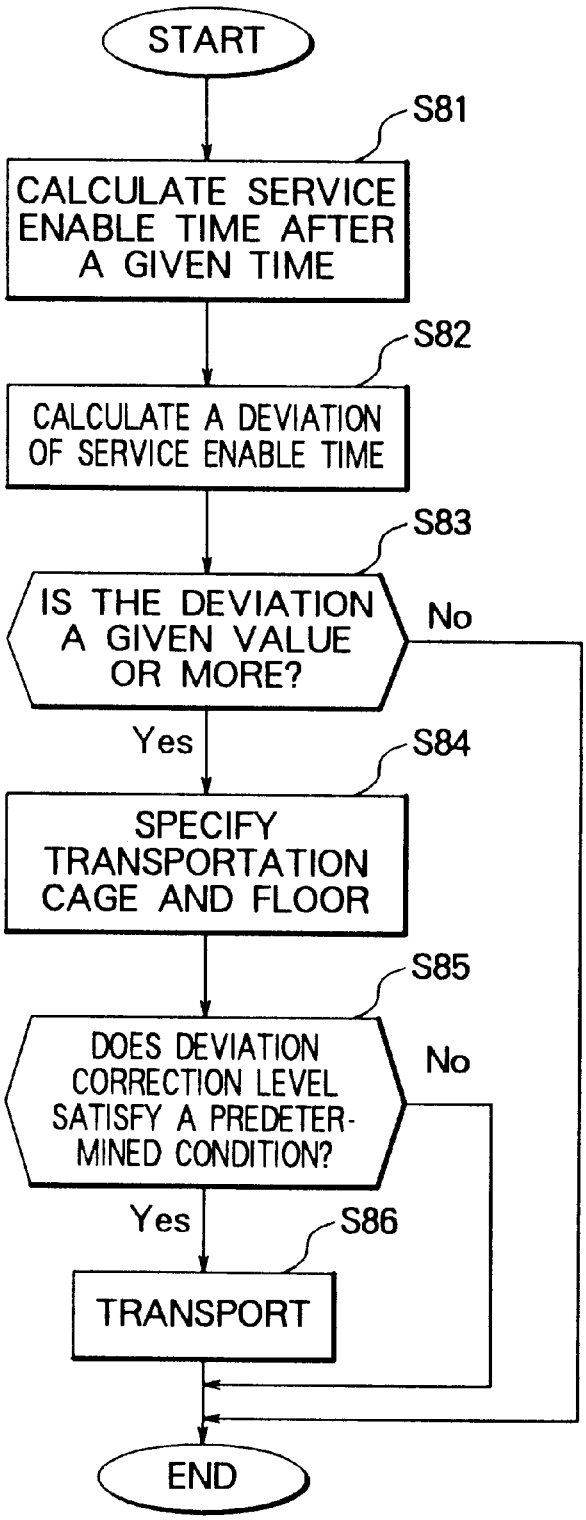
FIG. 20 is a flowchart for explaining the operation of the embodiment mode 2 shown in FIG. 19.

The above description is made assuming that the given time is 10 seconds in step S31 of FIG. 3 and in step S81 of FIG. 20. This value may be a fixed value, or increased or decreased depending on the frequency of traffic at that time. Also, when the mean time of generation of the elevator hall calls at that time is calculated, the value may be employed, and in any cases, transportation control with more accuracy can be conducted.

INDUSTRIAL APPLICABILITY

As was described above, the elevator control apparatus according to the present invention reduces a difference of the service enable time to the respective floors (a difference between the predicted maximum arrival time and the predicted minimum arrival time), and can keep the state in which any cage can responded to the call quickly even if the call is generated on any floor in the near future (after L seconds) , to thereby improve the service of the elevator. Also, since the transportation is made only in the case where the improvement of the deviation index is large, the useless transportation is omitted, and the transportation is always made only in a proper situation, to thereby improve the service of the elevator.

What is claimed is:

1. An elevator control apparatus comprising:

elevator assignment means for assignment of one elevator, from a plurality of elevators, to respond to an elevator hall call received from an elevator floor button;

service enable time calculating means for calculating a service enable time, which is a predicted arrival time, for each of the plurality of elevators to determine which of the plurality of elevators can respond to the elevator hall call fastest;

deviation calculating means for calculating a deviation index from a distribution of the service enable times calculated by said service enable time calculating means, the deviation index being at least one of mean value, standard deviation, and maximum value of the distribution of the service enable times;

transportation determining means for determining if transportation of an elevator is necessary, based on whether the deviation index calculated by said deviation calculating means exceeds a threshold;

transportation specifying means for specifying a designated elevator and a designated floor which would most reduce the deviation index when said transportation determining means determines that transportation of an elevator is necessary; and transportation instruction means for sending a transportation instruction to the designated elevator to transport the designated elevator to the floor.

2. The elevator control apparatus as claimed in claim 1, wherein said service enable time calculating means calculates a service enable time for each floor after generation of an elevator hall call.

3. The elevator control apparatus as claimed in claim 1, further comprising deviation correction determining means for determining whether the transportation of the designated elevator should be made, based on whether a condition of a deviation correction level is satisfied by the transportation of the designated elevator by said transportation specifying means to the designated floor, wherein said transportation instruction means sends the transportation instruction to the elevator designated by said transportation specifying means to transport the designated elevator to the designated floor when said deviation correction determining means determines that the transportation of the designated elevator should be made.

4. The elevator control apparatus as claimed in claim 3, wherein said deviation correction determining means determines whether the deviation correction level satisfies the condition by determining whether the deviation has been corrected based on comparison of the deviation index calculated by said deviation calculating means with the deviation index when said transportation specifying means specifies the designated elevator.

* * * * *